US005381734A

United States Patent [19]

Becker

[11] Patent Number: 5,381,734

[45] Date of Patent: Jan. 17, 1995

[54] WEB-FED ROTARY PRINTING PRESS WITH IMPRINTING UNIT FOR FLYING PRINTING-FORM EXCHANGE

[75] Inventor: Ludwig Becker, Reilingen, Germany

[73] Assignee: Heidelberger Druckmaschinen AG, Heidelberg, Germany

[21] Appl. No.: 199,856

[22] Filed: Feb. 22, 1994

[30] Foreign Application Priority Data

Feb. 22, 1993 [DE] Germany ..... 4305393

[51] Int. Cl.[6] ..... B41F 13/24

[52] U.S. Cl. ..... 101/247; 101/477; 101/181

[58] Field of Search ..... 101/247, 248, 477, 181–182, 101/137, 138, 139, 140, 117, 143, 144, 145, 177, 184, 217, 218, 216, 212, 227

[56] References Cited

U.S. PATENT DOCUMENTS

| | | | |
|---|---|---|---|
| 2,425,167 | 8/1947 | Whitehead . | |
| 3,869,983 | 3/1975 | Garber et al. | 101/181 |
| 4,346,656 | 8/1982 | Schwaab et al. . | |
| 4,696,229 | 9/1987 | Bezler et al. | 101/177 |
| 4,833,982 | 5/1989 | Liebert et al. | 101/247 |
| 5,063,844 | 11/1991 | Fausel | 101/247 |
| 5,186,103 | 2/1993 | Gezinas et al. | 101/247 |

FOREIGN PATENT DOCUMENTS

| | | |
|---|---|---|
| 0010141 | 8/1982 | European Pat. Off. . |
| 0196019 | 10/1986 | European Pat. Off. . |
| 581441 | 7/1933 | Germany . |
| 2844418 | 2/1982 | Germany . |
| 8410619.0 | 8/1985 | Germany . |
| 3917340 | 11/1990 | Germany . |
| 4038510 | 6/1992 | Germany . |
| WO87/04665 | 8/1987 | WIPO . |

*Primary Examiner*—Eugene H. Eickholt
*Attorney, Agent, or Firm*—Herbert L. Lerner; Laurence A. Greenberg

[57] ABSTRACT

A web-fed rotary printing press having a main drive includes, in combination, a plurality of consecutively arranged printing units and a printing unit for flying printing-form exchange having an auxiliary drive and a plurality of printing-unit cylinders, at least one of which has a shaft, the plurality of printing-unit cylinders including two printing-form cylinder-transfer cylinder pairs for the printing-form exchange, and a common, rotating impression cylinder driven via the main drive, one of the cylinder pairs being inactivatable and the other being bringable into engagement with the common, rotating impression cylinder so as to be driven by the main drive, two gearwheels positioned on the shaft of the one cylinder of the printing unit for the flying printing-form exchange, including a drive for the respective printing-form cylinder-transfer cylinder pair which is decouplable from the main drive, during an imprinting operation, and connectable via a coupling device with the auxiliary drive, includes an arrangement of the printing-form cylinders, the transfer cylinders and the impression cylinder in a substantially vertically extending installed position, a respective upper cylinder pair formed of one of the printing-form cylinders and one of the transfer cylinders, and a respective lower cylinder pair formed of the other of the printing-form cylinders and the other of the transfer cylinders being disengageable in common from the impression cylinder.

6 Claims, 6 Drawing Sheets

WEB-FED ROTARY PRINTING PRESS WITH IMPRINTING UNIT FOR FLYING PRINTING-FORM EXCHANGE

The invention relates to a web-fed rotary printing press having a plurality of consecutively arranged printing units and a printing unit for flying or on-the-run printing-form exchange, wherein one printing-form cylinder-transfer cylinder pair for the printing-form exchange can be inactivated and another can be brought into engagement with a common, rotating impression cylinder, two gearwheels are positioned on at least one printing-unit cylinder shaft of the printing unit for the flying printing-form exchange and, during an imprinting operation, a drive for the printing-form cylinder-transfer cylinder pair is decouplable from a main drive introduced via the impression cylinder and engageable by gear couplings with an auxiliary drive.

A web-fed rotary printing press with a device for producing printed matter with alternating imprints has become known heretofore in the state of the art, for example, from published German Patent Document 28 44 418 C3. In this heretofore known device, two drives for accelerating the speed of the printing units to press speed are provided. Furthermore, both of the printing units have common impression cylinders with diameters which are double that of each conventional printing-unit cylinder. This carries a disadvantage with it in that the lower printing unit must be built .quite deeply and, during the printing-form exchange, the body of the pressman or operator must be maintained in a sharply bent or stooped position, because servicing or operation of the device is performed from the web inlet side.

Moreover, a web-fed rotary printing press with a printing unit for flying plate exchange has become known heretofore in the state of the art as exemplified in published European Patent Document 0196 019 A2, wherein both an upper and a lower printing unit are shown as being connectible by one and the same auxiliary drive. A disadvantage of such a device, however, is that, when the material web is being printed on both sides thereof, the impression cylinder is swivelable out of contact with the printing units and functions as a paper guide roller. The danger arises that, over relatively long operation in the first-form and perfector printing or recto-verso printing mode, ink will be deposited on the outer cylindrical surface of the impression cylinder and will dry thereon over the passage of time.

In addition, with the selected printing-unit cylinder configuration assembled asymmetrically to the impression cylinder in recto-verso or first-form and perfector printing operation, an irregular vibration-excitation of the cylinders in the imprint unit due to alternatingly occurring gap impacts cannot be excluded.

It is accordingly an object of the invention, starting from the aforedescribed state of the art, to provide, in a web-fed rotary printing press having a plurality of consecutively arranged printing units, an imprint unit for flying printing-form exchange disposed upstream from the printing units, as viewed in the travel direction of the web, and having an improved user-friendliness and running-quietness.

With the foregoing and other objects in view, there is provided, in accordance with the invention, in a web-fed rotary printing press having a main drive, in combination, a plurality of consecutively arranged printing units and a printing unit for flying printing-form exchange having an auxiliary drive and a plurality of printing-unit cylinders, at least one of which has a shaft, the plurality of printing-unit cylinders including two printing-form cylinder-transfer cylinder pairs for the printing-form exchange, and a common, rotating impression cylinder driven via the main drive, one of the cylinder pairs being inactivatable and the other being bringable into engagement with the common, rotating impression cylinder so as to be driven by the main drive, two gearwheels positioned on the shaft of the one cylinder of the printing unit for the flying printing-form exchange, including a drive for the respective printing-form cylinder-transfer cylinder pair which is decouplable from the main drive, during an imprinting operation, and connectable via coupling means with the auxiliary drive, comprising an arrangement of the printing-form cylinders, the transfer cylinders and the impression cylinder in a substantially vertically extending installed position, a respective upper cylinder pair formed of one of the printing-form cylinders and one of the transfer cylinders, and a respective lower cylinder pair formed of the other of the printing-form cylinders and the other of the transfer cylinders being disengageable in common from the impression cylinder.

This construction according to the invention offers many advantages. Due to the vertically extending arrangement of the printing-unit cylinders in the imprinting unit, the greatest possible stiffness of the cylinders in the imprinting unit is assured against bending. Due to the extended manner of construction, the main components of the forces released by the rotating structural members in both printing units act against one another and the effects thereof mutually cancel. Streak formation in the printing is thereby able to be minimized and the printing quality increased. Because the individual printing-unit cylinders of a printing unit are disengageable respectively in common from the impression cylinder, the disengaging eccentrics can have small dimensions.

In accordance with another feature of the invention, the upper cylinder pair and the lower cylinder pair, respectively, are disposed symmetrically to the impression cylinder. Due to the selection of a symmetric printing-unit cylinder configuration, a simultaneous occurrence of the mutual roll-over or roll-by of the gaps both in the respective printing units internally, as well as with respect to the common impression cylinder, is achievable. This greatly promotes an improvement in the running quietness of the imprinting unit in the recto/verso or first-form and perfector printing operation.

In accordance with a further feature of the invention, the combination includes a respective disc clutch and a respective gear coupling assigned to the printing-unit cylinders of the upper cylinder pair and of the lower cylinder pair. The acceleration of the printing-unit cylinders of the respective printing units is introduced via the disc clutch, while the main drive via the gear coupling takes over the drive of the respective printing units after the acceleration to the press speed. For determining the correct engagement or coupling position for the gear coupling, in accordance with an added feature of the invention, the combination includes respective rotary transmitters provided for each of the upper and the lower cylinder pairs.

In accordance with an additional feature of the invention, the respective rotary transmitters are mounted on the respective shafts of the one cylinder of each of the upper and the lower cylinder pairs, and respective gear couplings are mounted on the respective shafts.

In accordance with a concomitant feature of the invention, the respective gear coupling assigned to the printing-unit cylinders of the upper and the lower cylinder pairs are separately mounted. The gear coupling is thus not mounted on a cylinder journal, much less a rubber cylinder journal, thereby avoiding the possibility of the bending of the journal pin due to the intrinsic weight of the coupling.

Other features which are considered as characteristic for the invention are set forth in the appended claims.

Although the invention is illustrated and described herein as embodied in a web-fed rotary printing press with an imprint unit for flying printing-form exchange, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
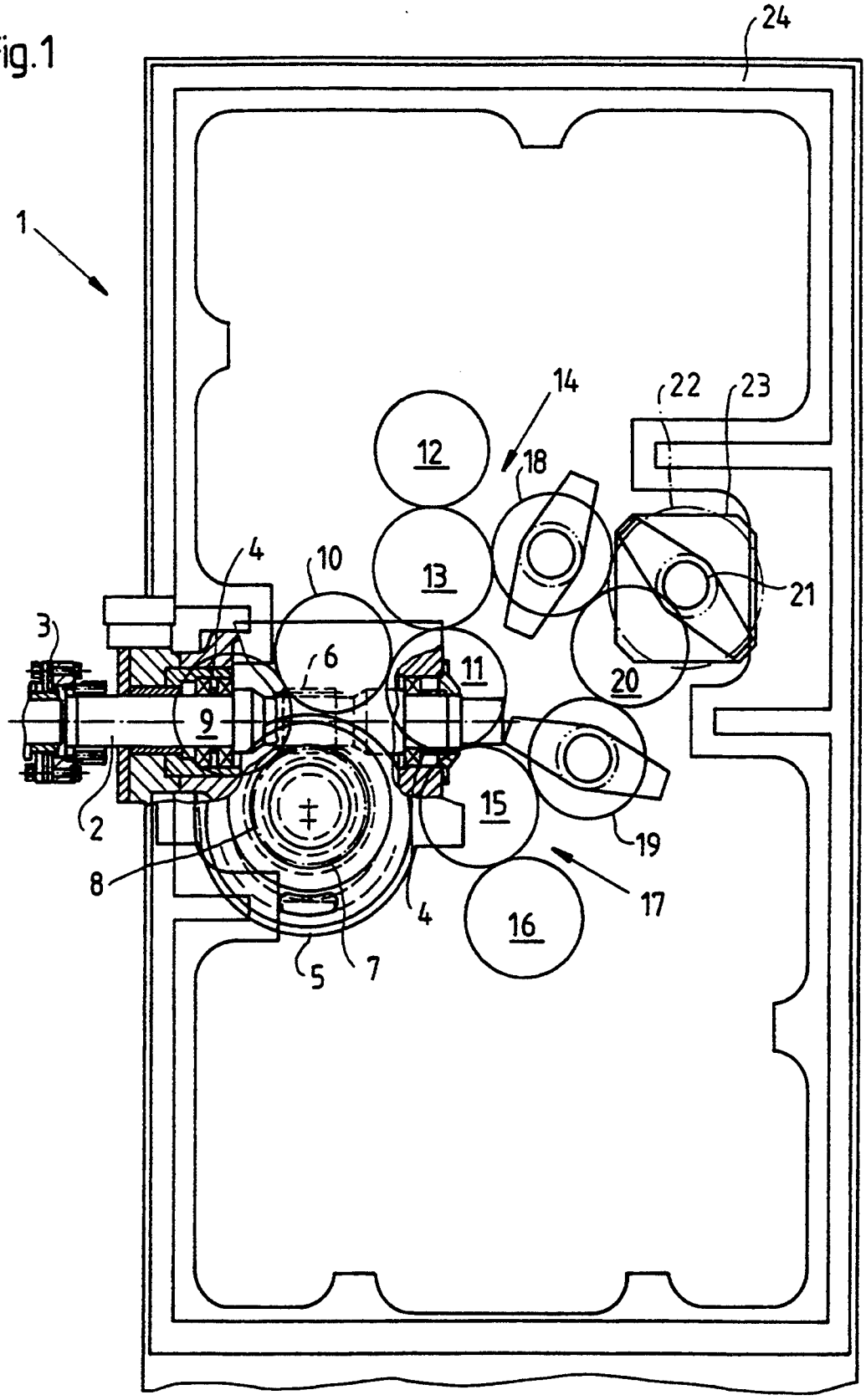
FIG. 1 is a diagrammatic side elevational view of the drive side of an imprinting unit together with an auxiliary drive therefor.

Referring now to the drawings and, first, particularly to FIG. 1 thereof, there is shown therein, in a diagrammatic side elevational view, the drive side of an imprinting unit 1 with an auxiliary drive.

The imprinting unit 1 is mounted upstream, in the travel direction of a web through the printing press, from a succession of in-line arranged printing units and is driven by an elongated shaft 2 of an otherwise non-illustrated main drive of a rotary printing press. The elongated shaft 2 terminates via a coupling 3 in a transmission 5 flanged to a side wall 24. The elongated shaft 2 is braced by a shaft bearing 4 in the transmission 5 and drives a worm 6 which meshes with a worm wheel or gear 7. The output or power take-off 8 of the worm transmission is transferred to an intermediate gear 9 which drives an impression cylinder 11 via a further intermediate gear 10. Two printing-unit cylinders, namely an upper printing-form cylinder 12 and an upper transfer cylinder 13, both of which form an upper printing unit 14, are arranged above the impression cylinder 11. Below the impression cylinder 11, a printing unit 17 is arranged which includes a lower transfer cylinder 15 as well as a lower printing-form cylinder 16. An intermediate gear 20 serving as a distributor wheel is driven from an auxiliary drive 22 flanged to the side wall 24, via a pinion 21, and acts both on an upper multiple disc clutch 18 as well as on a lower multiple disc clutch 19.

The impression cylinder 11, in accordance with the configuration illustrated in FIG. 1, is continuously connected with the transmission 5 acted upon by the main drive via the elongated shaft 2. The auxiliary drive 22 connectable with the upper printing unit 14 as well as the lower printing unit 17 serves for accelerating the speed of the respective printing units 14 and 17 up to the full press speed again after the printing-form exchange thereof.

Figure 2:
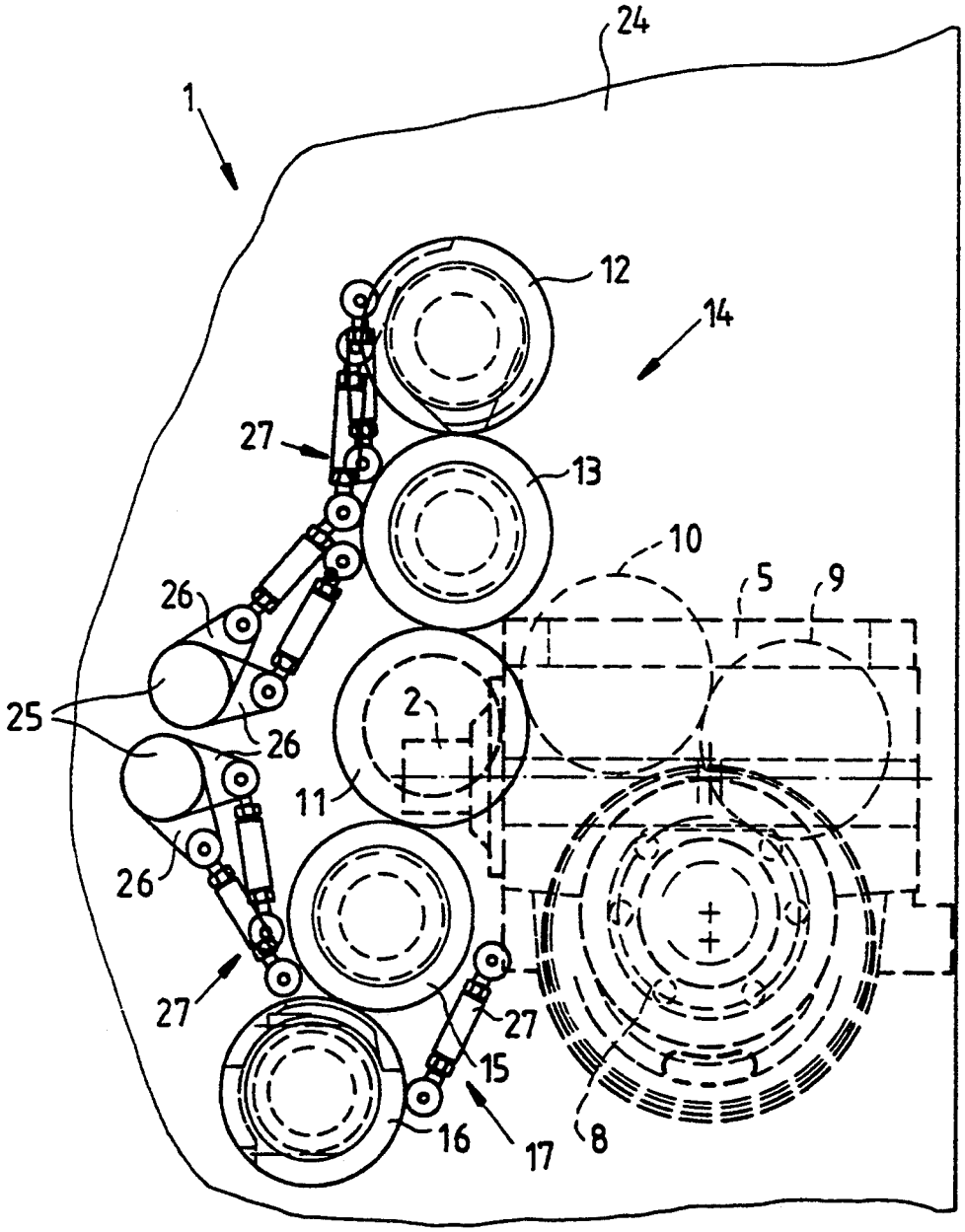
FIG. 2 is an enlarged fragmentary view of FIG. 1 as seen from the other side of the plane of the drawing of FIG. 1 and showing an inactivating or stopping mechanism for the individual printing unit cylinders.

FIG. 2 is a diagrammatic view of the inactivating or stopping mechanism of the individual printing-unit cylinders from the operating side of the imprint unit. As is apparent, the view therein is a mirror image of that shown in FIG. 1. The components 2, 5, 8, 9 and 10 shown in broken lines in FIG. 2 are located behind the plane of the drawing. On bars or traverses 25 actuatable by operating cylinders, operating forks 26 are provided which are connected by a respective operating linkage 27 with the printing-unit cylinders 12 and 13 of the upper printing unit 14 and the printing-unit cylinders 15 and 16 of the lower printing unit 17. Small inactivating or stopping eccentrics can be used, because a simultaneous stopping or inactivating of both of the printing-unit cylinders 12 and 13 of the upper printing unit and a simultaneous stopping or inactivating of both of the printing-unit cylinders 15 and 16 of the lower printing unit 17 can be effected by means of this configuration.

Figure 3:
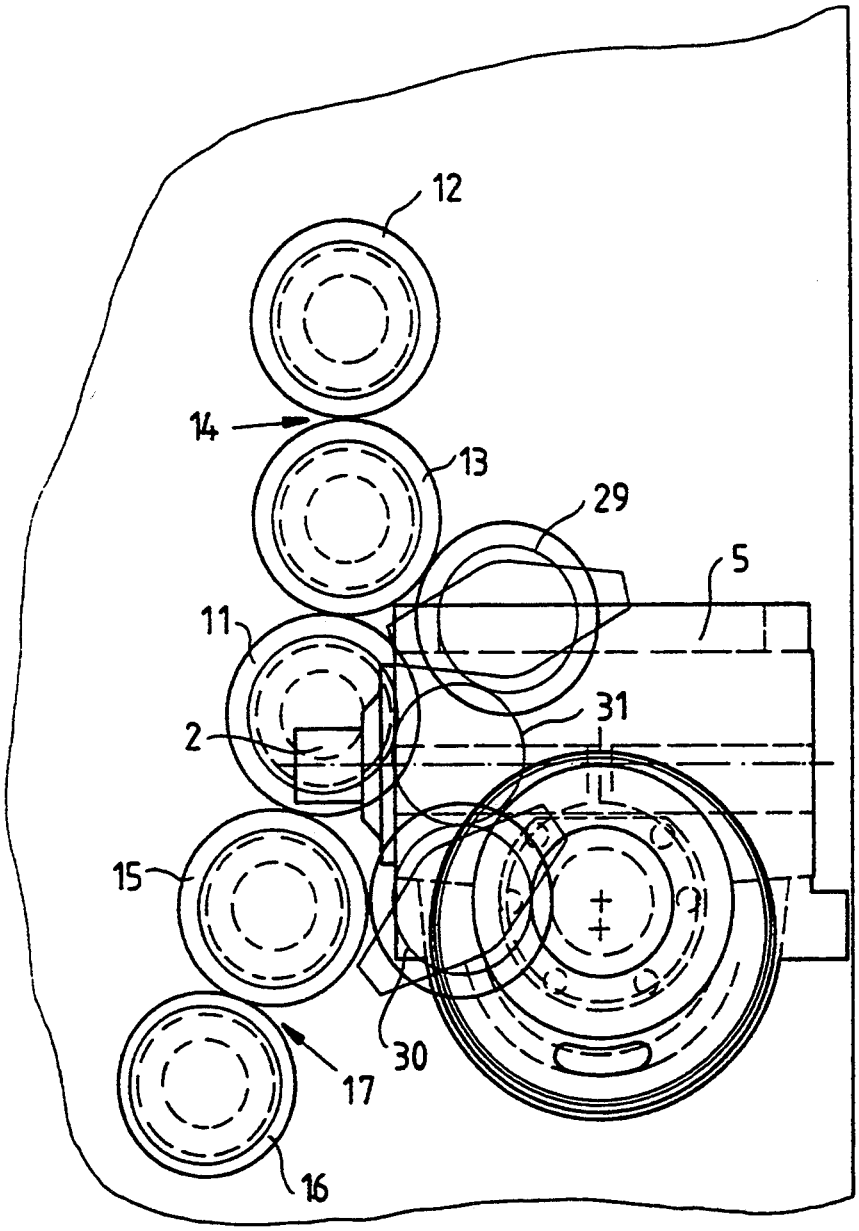
FIG. 3 is a view like that of FIG. 2 of another embodiment of the invention, having gear couplings connectable via an intermediate gear and assigned to the respective printing units.

An alternative drive conception of the printing units 14 and 17 of the imprinting unit 1 is illustrated in FIG. 3.

Starting from the transmission 5 is a drive of an intermediate gear 31 in meshing engagement with gears of gear couplings 29 and 30, respectively, which, in turn, mesh with gears of the transfer cylinders 13 and 15, respectively. One of the two printing units 14 and 17, respectively, can be connected with the main drive via the respective actuatable gear couplings 29 and 30.

Figure 4:
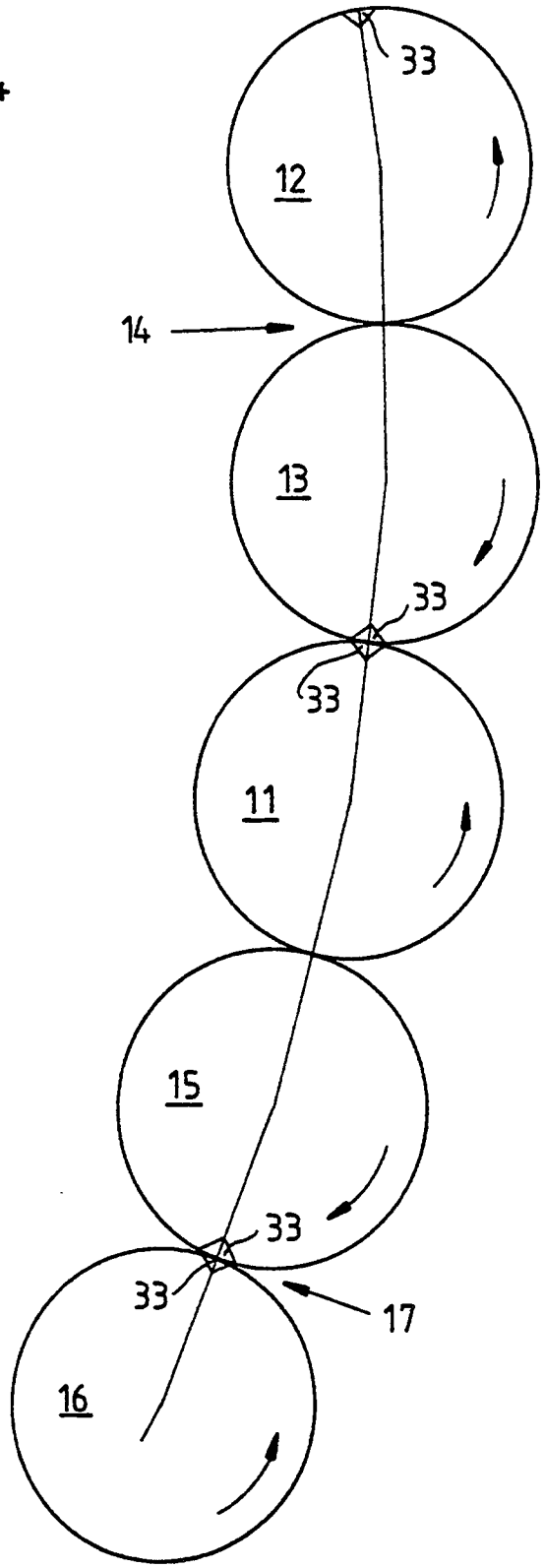
FIGS. 4 and 5 are an enlarged fragmentary diagrammatic view of the printing-unit cylinders as shown in FIGS. 2 and 3 in different phases of rotation thereof wherein respective mutual roll-overs of the gaps formed therein occur.
Figure 5:
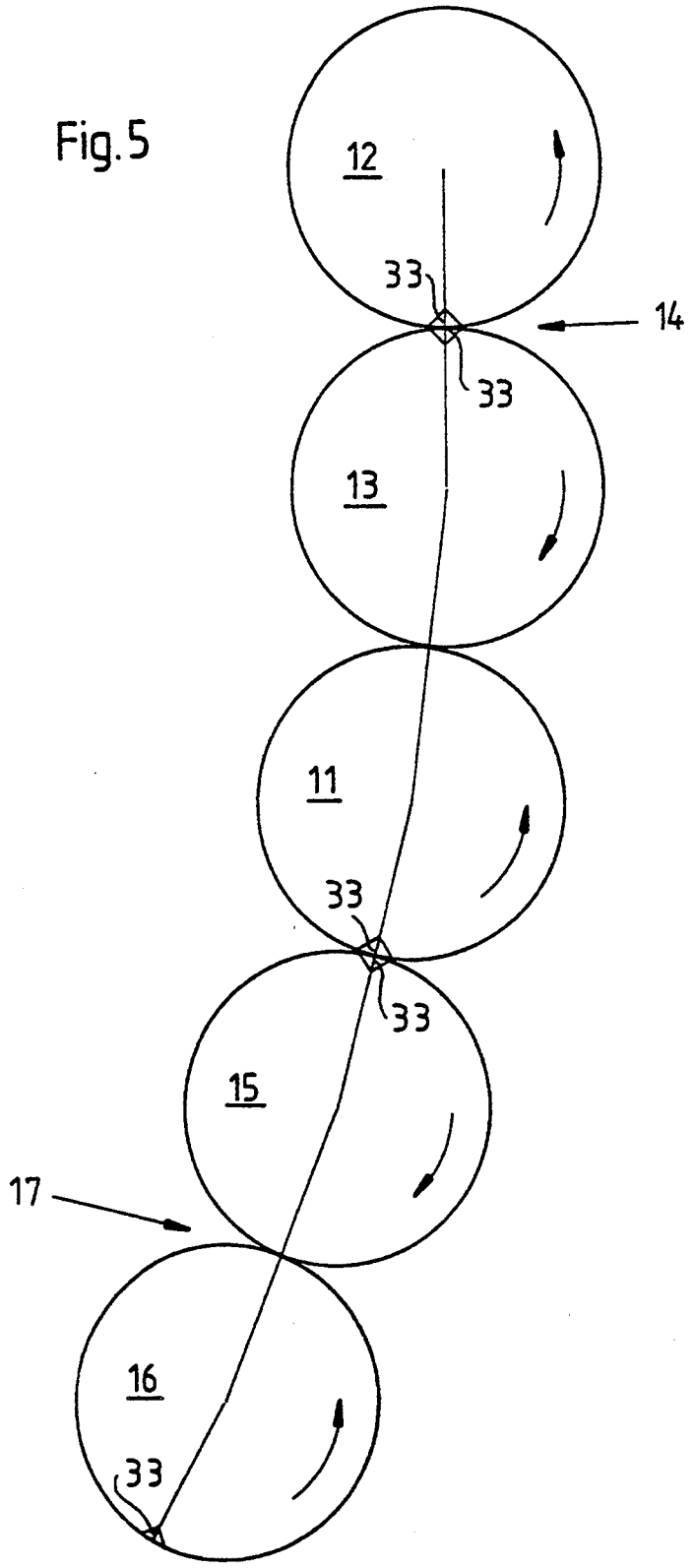

In FIGS. 4 and 5, periodically occurring angular positions of the individual printing-unit cylinders are shown during the rotation thereof.

From the two last-mentioned figures, the substantially vertically extending arrangement of the individual printing-unit cylinders 11, 12, 13, 15 and 16 with respect to one another is clearly displayed. In FIG. 4, a mutual roll-over or roll-by of the respective gaps 33 of the upper transfer cylinder 13 and the impression cylinder 11 is shown. Simultaneously, in the lower printing unit 17, there is a mutual roll-over or roll-by of the respective cylinder gaps 33 of the lower transfer cylinder 15 and the lower printing-form cylinder 16. Due to the extended construction of the imprinting unit 1 and the selected arrangement of both printing units 14 and 17 symmetrically to the impression cylinder 11, the main components of the forces induced by the roll-by of the cylinder gaps 33 are mutually cancelled. A lesser bending of the individual printing-unit cylinders is thereby achievable, which results in a considerable improvement in the problem of streaking. With regard to FIG. 5, a mutual roll-by of the gaps 33 of the impression cylinder 11 and the lower transfer cylinder 15 occurs. Parallel thereto, the channels 33 of the printing-unit cylinders 12 and 13 of the upper printing unit 14 roll by and on one another. Thereafter, during the roll-by operation of the gap 33 of the impression cylinder 11 and a gap 33 of one of the transfer cylinders 13 and 15, respectively, there results alternatingly simultaneously a gap roll-by either between the printing-form cylinder 12 and the transfer cylinder 13 of the upper printing unit 14 or a gap roll-by of the printing-unit cylinders 15 and 16 of the lower printing unit 17.

Figure 6:
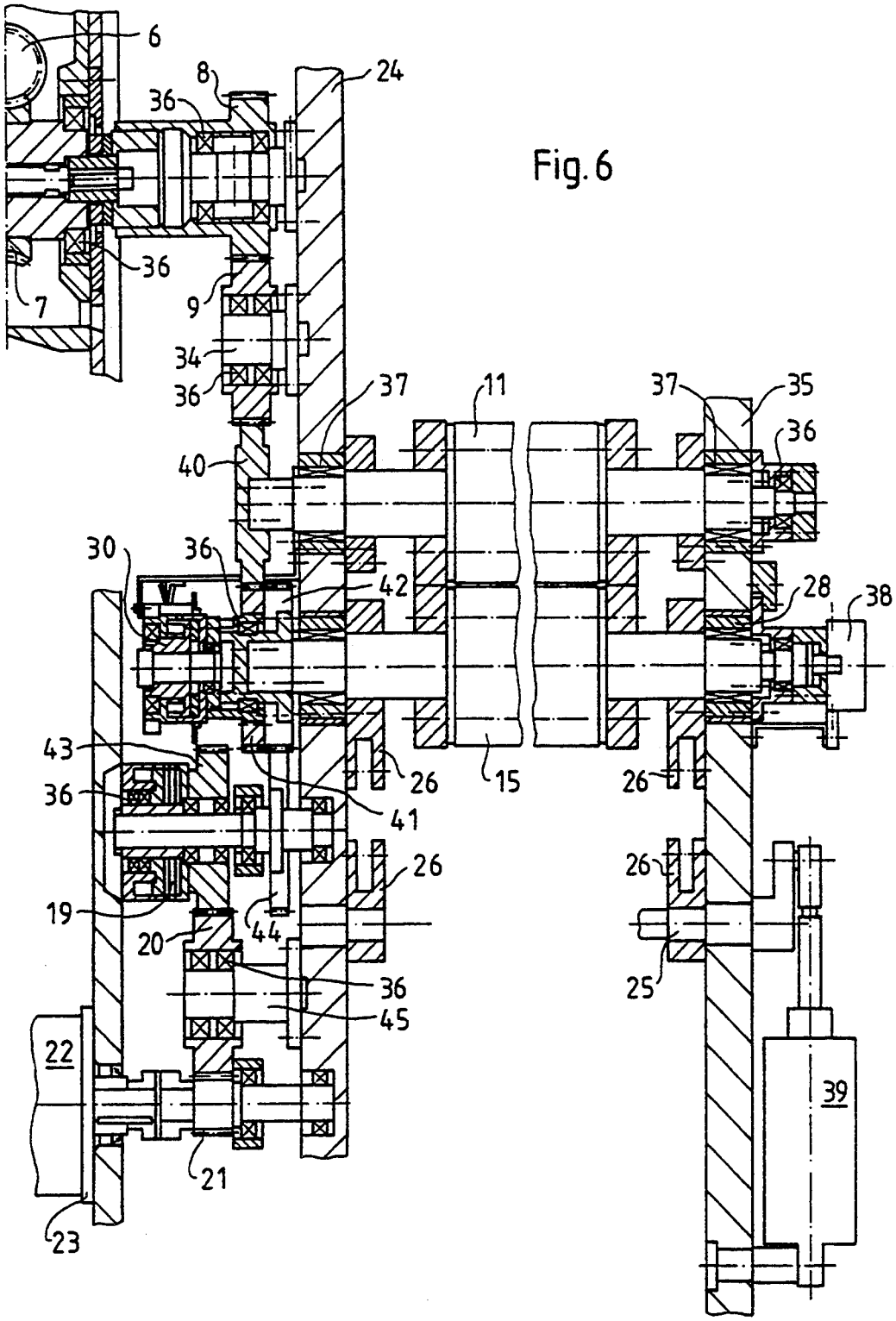
FIG. 6 is an enlarged cross-sectional view of FIG. 1 taken through the imprinting unit from the drive side to the operating side thereof.

FIG. 6 is a cross-sectional view of the imprinting unit 1 from the drive side to the operating side thereof.

The drive introduced through the main drive into the imprinting unit 1 is transmitted via the worm 6 and the worm gear 7 and then reaches the output gear or power take-off 8. The output gear 8 is mounted by a bearing 36 on a pin or journal fastened to the side wall 24. The intermediate gear 9 mounted with bearings 36 on a journal pin 34 on the side wall 24 transmits the drive via the intermediate gear 10 (note FIG. 1, for example), which is disposed above the intermediate plane, on a drive gear 40 of the impression cylinder 11, which is fixed in position by cylinder bearings 37 in the side walls 24 and 35. From the drive gear 40, the drive runs to a gear 41 which is mounted with bearings 36 on the journal of the transfer cylinder 15, and the torque transmission thereof is engageable and disengageable via the gear coupling or clutch 29. The transfer cylinder 15 is mounted in cylinder bearings 37 which, however, in contrast with the bearing of the impression cylinder 11, is received in eccentric bushings 28 which have positioning forks 26 formed thereon. Disposed opposite these positioning forks 26 are other positioning forks 26 which are fastened to a bar or traverse 25. The positioning linkage 27 between the positioning forks 26 have not been illustrated in FIG. 6, in the interest of clarity. The traverse 25 is actuated by a positioning cylinder 39 mounted on the side wall 35, whereby the printing-unit cylinders 15 and 16 of the lower printing unit 17 are disconnectable from the impression cylinder 11 in common. Analogous conditions apply for the printing-form cylinder 12 not otherwise shown in FIG. 6 and the transfer cylinder 13 of the upper printing unit 14.

The cylinder journal pin of the transfer cylinder 15 proceeds via a further gear 42, which meshes with a gear 44 which, in turn, is mounted with a clutch gearwheel 43 and the appertaining multiple disc clutch 19 on a stub shaft. The clutch gear 43 of the disc clutch 19 is driven from the intermediate gear 20, which is mounted by bearings 36 on a journal 45 provided on the side wall 24. The intermediate gear 20 meshes with a pinion 21 of the auxiliary drive 22 which is fastened by the flange 23 to the imprinting unit 1.

Hereinafter, an exchange from the upper printing unit 14 to the lower printing unit 17 is briefly described.

Starting from the upper printing unit 14, which is to be considered as the instantaneous end of printing, the drive thereof proceeds through the connected or engaged gear coupling or clutch 30; a rotary transmitter 38 arranged on the cylinder journal of the upper transfer cylinder 13 thrusting through the side wall 35 serves for detecting the correct coupling or engaging position and for comparing or equalizing the rotary speed after the acceleration due to the auxiliary drive 22. Because the drive is applied instantaneously via the main drive, the upper disc clutch 18 is decoupled or disengaged.

The lower printing unit 17 is accelerated after the printing-form exchange has taken place. The gear coupling or clutch 30 is decoupled or disengaged; after the lower disc clutch 19 has been engaged, the lower printing unit 17 is accelerated via the auxiliary drive 22 and the components 21, 20, 43, 44 and 42 nearly to press speed. By means of the rotary transmitter 38 arranged on the cylinder journal at the operating side of the lower transfer cylinder 15, both the engaged or coupled position for the clutch or gear coupling 30, as well as the concurrence or conformity of the press speeds are determined. After engagement or connection of the clutch or gear coupling 30 and the drive connection to the main drive produced thereby, the disc clutch 18 connects the upper printing unit 14, the disc clutch 19 simultaneously disconnects the lower printing unit 17, and the gear coupling or clutch 29 disconnects the upper printing unit 14. Due to the connection of the printing unit 14 with the auxiliary drive 22 because of the engagement or connection of the upper disc clutch 18, the upper printing unit 14 can be braked thereby and made ready for printing-form exchange.

I claim:

1. In a web-fed rotary printing press having a main drive, in combination, a plurality of consecutively arranged printing units and a printing unit for flying printing-form exchange having an auxiliary drive and a plurality of printing-unit cylinders, at least one of which has a shaft, the plurality of printing-unit cylinders including two printing-form cylinder-transfer cylinder pairs for the printing-form exchange, and a common, rotating impression cylinder driven via the main drive, one of the cylinder pairs being inactivatable and the other being bringable into engagement with the common, rotating impression cylinder so as to be driven by the main drive, two gearwheels positioned on the shaft of the one cylinder of the printing unit for the flying printing-form exchange, including a drive for the respective printing-form cylinder-transfer cylinder pair which is decouplable from the main drive, during an imprinting operation, and connectable via coupling means with the auxiliary drive, comprising an arrangement of the printing-form cylinders, the transfer cylinders and the impression cylinder in a substantially vertically extending installed position, a respective upper cylinder pair formed of one of the printing-form cylinders and one of the transfer cylinders, and a respective lower cylinder pair formed of the other of the printing-form cylinders and the other of the transfer cylinders being disengageable in common from the impression cylinder.

2. The combination according to claim 1, wherein the upper cylinder pair and the lower cylinder pair, respectively, are disposed symmetrically to the impression cylinder.

3. The combination according to claim 1, including a respective disc clutch and a respective gear coupling assigned to the printing-unit cylinders of the upper cylinder pair and of the lower cylinder pair.

4. The combination according to claim 1, including respective rotary transmitters provided for each of the upper and the lower cylinder pairs.

5. The combination according to claim 4, wherein the respective rotary transmitters are mounted on the respective shafts of the one cylinder of each of the upper and the lower cylinder pairs, and including respective gear couplings mounted on the respective shafts.

6. The combination according to claim 3, wherein the respective gear coupling assigned to the printing-unit cylinders of the upper and the lower cylinder pairs are separately mounted.

* * * * *